US008425266B2

(12) United States Patent
Ono et al.

(10) Patent No.: US 8,425,266 B2
(45) Date of Patent: Apr. 23, 2013

(54) TERMINAL CONNECTOR AND ELECTRIC WIRE WITH TERMINAL CONNECTOR

(71) Applicants: Autonetworks Technologies, Ltd., Yokkaichi (JP); Sumitomo Wiring Systems, Ltd., Yokkaichi (JP); Sumitomo Electric Industries, Ltd., Osaka (JP); Toyota Jidosha Kabushiki Kaisha, Toyota (JP)

(72) Inventors: Junichi Ono, Yokkaichi (JP); Hiroki Hirai, Yokkaichi (JP); Tetsuji Tanaka, Yokkaichi (JP); Hiroki Shimoda, Yokkaichi (JP); Takuji Otsuka, Yokkaichi (JP); Masaaki Tabata, Yokkaichi (JP); Kenji Okamura, Yokkaichi (JP); Kazuhiro Aoki, Toyota (JP); Hiroshi Kobayashi, Okazaki (JP); Takahito Nakashima, Okazaki (JP)

(73) Assignees: Autonetworks Technologies, Ltd., Mie (JP); Sumitomo Wiring Systems I, Ltd., Mie (JP); Sumitomo Electric Industries, Ltd., Osaka (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/645,369

(22) Filed: Oct. 4, 2012

(65) Prior Publication Data

US 2013/0062118 A1 Mar. 14, 2013

Related U.S. Application Data

(63) Continuation of application No. 13/121,555, filed as application No. PCT/JP2010/057138 on Apr. 22, 2010, now Pat. No. 8,337,262.

(30) Foreign Application Priority Data

Apr. 24, 2009 (JP) ..... 2009-106779
Dec. 22, 2009 (JP) ..... 2009-291042

(51) Int. Cl.
*H01R 4/18* (2006.01)

(52) U.S. Cl.
USPC ..... 439/877

(58) Field of Classification Search ..... 439/877–882
See application file for complete search history.

(56) References Cited

U.S. PATENT DOCUMENTS

| | | | | |
|---|---|---|---|---|
| 5,316,506 | A | 5/1994 | Ito | |
| 5,370,560 | A | 12/1994 | Ito | |
| 6,749,457 | B2 | 6/2004 | Sakaguchi et al. | |
| 8,177,591 | B2 * | 5/2012 | Okamura et al. | 439/877 |
| 8,246,394 | B2 * | 8/2012 | Ono et al. | 439/877 |
| 8,303,354 | B2 * | 11/2012 | Ootsuka et al. | 439/877 |
| 8,303,355 | B2 * | 11/2012 | Ono et al. | 439/877 |

FOREIGN PATENT DOCUMENTS

| | | |
|---|---|---|
| JP | A-5-152011 | 6/1993 |
| JP | A-10-125362 | 5/1998 |

OTHER PUBLICATIONS

Notice of Allowance dated Oct. 23, 2012 issued in U.S. Appl. No. 13/121,555.

(Continued)

*Primary Examiner* — Gary F. Paumen
(74) *Attorney, Agent, or Firm* — Oliff & Berridge, PLC

(57) ABSTRACT

An electric wire with a terminal connector includes an electric wire and a female terminal connector crimped onto a core wire exposed at the electric wire. A female terminal connector has a wire barrel having a surface to be applied to the core wire. The surface has a plurality of recesses formed therein. Each recess has an opening edge. The opening edge of the recess includes first opening edges that are parallel to each other. The space between the recesses adjacent to each other in the extending direction of the first opening edge is set narrower than the space between the recesses adjacent to each other in the extending direction of the electric wire.

6 Claims, 11 Drawing Sheets

OTHER PUBLICATIONS

International Search Report mailed Jun. 8, 2010 issued in International Patent Application No. PCT/JP2010/057138 (with translation).

Written Opinion of the International Searching Authority mailed Jun. 8, 2010 issued in International Patent Application No. PCT/JP2010/057138 (with partial translation).

* cited by examiner

TERMINAL CONNECTOR AND ELECTRIC WIRE WITH TERMINAL CONNECTOR

This application is a continuation application of application Ser. No. 13/121,555 filed Mar. 29, 2011, which is a National Stage Application of PCT/JP2010/057138 filed Apr. 22, 2012. The disclosures of the parent applications are incorporated by reference herein in their entireties.

TECHNICAL FIELD

The present invention relates to a terminal connector and an electric wire with a terminal connector.

BACKGROUND ART

A terminal connector to be connected to an end of an electric wire is conventionally known as described in Patent Document 1. The terminal connector includes a crimping portion made by pressing a metal plate. The crimping portion is crimped onto a core wire exposed at the end of the electric wire.

If an oxide layer is formed on the core wire, the oxide layer intervenes between the core wire and the crimping portion. This may cause increase in contact resistance between the core wire and the crimping portion.

Therefore, in the conventional art, grooves (serrations) are formed in the inner side (the core-wire side) of the crimping portion. The grooves continuously extend in a direction crossing the extending direction of the electric wire. The plurality of grooves are spaced in the extending direction of the electric wire. The grooves are formed by press molding a metal plate with a die.

When the crimping portion is crimped onto the core wire of the electric wire, the crimping portion presses the core wire so that the core wire plastically deforms in the extending direction of the wire. Then, opening edges of the grooves come into scraping contact with the oxide layer on the surface of the core wire, thereby removing the oxide layer. Then, the new surface of the core wire and the crimping portion come into contact with each other. This can reduce the contact resistance between the electric wire and the terminal connector.

CONVENTIONAL ART

Patent Document

Patent Document 1: Japanese Unexamined Patent Application Publication No. 10-125362

Recent years, using aluminium or aluminium alloy as a material of core wires has been studied. An oxide layer is formed with relative ease on the surface of the aluminium or aluminium alloy. Accordingly, if the aluminium or aluminium alloy is used as the core wires of electric wires, reduction in the electric resistance between the core wire and a crimping portion can be insufficient even if the grooves are formed.

Therefore, it is conceivable to arrange a plurality of recesses in the extending direction of the electric wire and, furthermore, arrange in a direction crossing the extending direction of the electric wire. This increases the area of opening edges of the recesses than the simple case where the grooves are spaced in the extending direction of the electric wire. This raises the expectations that the oxide layer on the core wire can surely be removed.

However, the above-described configuration may cause increase in the cost of manufacturing a die for forming the recesses due to as follows. The die has to have protrusions formed in positions corresponding to the recesses of the crimping portion. The protrusions are formed by cutting out a metal part. Then, depending on the layout of the recesses, the metal part may have to be cut out by electrical-discharge machining. This causes the increase in the cost of manufacturing the die.

Therefore, there is a need in the art to provide a terminal connector and an electric wire with a terminal connector having a lower electrical resistance between an electric wire while requiring a lower cost of manufacturing the die.

SUMMARY

The technique described in the specification is a terminal connector including a crimping portion configured to be crimped onto a core wire exposed at an electric wire in a binding manner. The electric wire includes the core wire including aluminium or aluminium alloy. The terminal connecter is characterized in that: in a state where the crimping portion is crimped onto the core wire, the crimping portion has a surface to be applied to the core wire, the surface having a plurality of recesses formed therein, each recess having a parallelogram-shaped opening edge, the opening edge of the recess including a pair of first opening edges and a pair of second opening edges, the first opening edges being parallel to each other, the second opening edges being parallel to each other and differing from the first opening edges, the recesses being spaced in an extending direction of the first opening edges and being spaced in an extending direction of the second opening edges; the first opening edge has an angle from 85 deg. to 95 deg. to the extending direction of the electric wire, and the second opening edge has an angle from 25 deg. to 35 deg. to the extending direction of the electric wire; and the opening edge and a bottom surface of each recess are connected by four inclined surfaces, the inclined surfaces having a pair of first inclined surfaces and a pair of second inclined surfaces, the first inclined surfaces connecting the respective first opening edges with the bottom surface of each recesses, each first inclined surface having an angle from 90 deg. to 110 deg. to a surface that is a part of the surface of the crimping portion to be applied to the core wire, the part having none of the recesses formed therein, the second inclined surfaces connecting the respective second opening edges with the bottom surface of each recesses, and each second inclined surface having an angle from 115 deg. to 140 deg. to the surface that is the part of the surface of the crimping portion to be applied to the core wire, the part having none of the recess formed therein.

Furthermore, the technique described in the specification is an electric wire with a terminal connector. The electric wire includes: an electric wire having a core wire including aluminium or aluminium alloy and wire insulation on the outer periphery of the core wire; and a terminal connector crimped onto the core wire exposed from the electric wire. The electric wire is characterized in that: the terminal connector includes a crimping portion to be crimped onto the core wire in a binding manner. In a state where the crimping portion is crimped onto the core wire, the crimping portion has a surface to be applied to the core wire, the surface having a plurality of recesses formed therein, each recess having a parallelogram-shaped opening edge, the opening edge of the recess including a pair of first opening edges and a pair of second opening edges, the first opening edges being parallel to each other, the second opening edges being parallel to each other and differing from the first opening edges, the recesses being spaced in an extending direction of the first opening edges and being spaced in an extending direction of the second opening edges;

the first opening edge has an angle from 85 deg. to 95 deg. to the extending direction of the electric wire, and the second opening edge has an angle from 25 deg. to 35 deg. to the extending direction of the electric wire; and the opening edge and a bottom surface of each recess are connected by four inclined surfaces, the inclined surfaces having a pair of first inclined surfaces and a pair of second inclined surfaces, the first inclined surfaces connecting the respective first opening edges with the bottom surface of each recesses, each first inclined surface having an angle from 90 deg. to 110 deg. to a surface that is a part of the surface of the crimping portion to be applied to the core wire, the part having none of the recesses formed therein, the second inclined surfaces connecting the respective second opening edges with the bottom surface of each recesses, and each second inclined surface having an angle from 115 deg. to 140 deg. to the surface that is the part of the surface of the crimping portion to be applied to the core wire, the part having none of the recess formed therein.

In accordance with the technique described in the specification, the edges of the opening edges of the recesses remove an oxide layer on the surface of the core wire to expose a new surface of the core wire. The new surface comes into contact with the crimping portion so that the core wire comes into electrical connection with the terminal connecter. This reduces the electrical resistance between the electric wire and the terminal connector.

Furthermore, in accordance with the technique described in the specification, the die for forming the recesses of the crimping portion can be manufactured by: cutting a plurality of grooves in a direction along the first opening edges of the recesses; and cutting a plurality of grooves in a direction along the second opening edges of the recesses. This can reduce the cost of manufacturing the die.

If the core wire is made of aluminium or aluminium alloy, the oxide layer is formed with relative ease on the surface of the core wire. In accordance with the technique described in the specification, the electrical resistance can be lower even if the core wire is made of aluminium or aluminium alloy.

Furthermore, in accordance with the technique described in the specification, each first opening edge crosses at the angle from 85 deg. to 95 deg. to the extending direction of the core wire. Therefore, when a force is applied in the extending direction of the electric wire to the electric wire in a state crimped by the crimping portion, the edges of the first opening edges suppress the movement of the core wire. This ensures contact of the new surface, which is formed by scraping contact with the opening edges of the recesses, of the core wire with the surface around the recesses of the crimping portion. As a result of this, the electrical resistance between the electric wire and the terminal connector can surely be reduced.

On the other hand, if the angle between the first opening edges and the extending direction of the core wire is less than 85 deg. or exceeds 95 deg., retaining the movement of the core wire by the edges of the first opening edges can be insufficient when the force is applied to the electric wire in the extending direction of the electric wire. Then, the core wire can be forced to move in the direction away from the surface of the crimping portion. This causes the new surface of the core wire to partially lose electrical connection with the crimping portion. As a result of this, reduction in electrical resistance between the electric wire and the crimping portion can be insufficient. Therefore, such an angle is unsuitable.

Furthermore, in the technique described in the specification, the angle between the first inclined surface and the surface that is the part of the surface of the wire barrel to be applied to the core wire, the part having no recess, is from 90 deg. to 110 deg., i.e. is relatively small. Accordingly, the edge of the first opening edge of the recess is relatively sharp. As a result of this, the edge of the first opening edge can surely remove the oxide layer on the core wire. If the angle between the first inclined surface and the surface that is the part of the surface of the wire barrel to be applied to the core wire, the part having no recess, is less than 90 deg., the die is difficult to remove at a time of press molding the recesses. Therefore, such an angle is unsuitable. Furthermore, if the angle is greater than 110 deg., the oxide layer on the core wire cannot be sufficiently removed. Therefore, such an angle is unsuitable.

Furthermore, in accordance with the technique described in the specification, each second opening edge has the angle from 25 deg. to 35 deg. to the extending direction of the electric wire. Therefore, the first opening edges of the recesses adjacent to each other in the extending direction of the electric wire overlap with respect to the extending direction of the electric wire. This provides still further improvement in the retention force of the crimping portion on the core wire. If the angle between the second opening edges and the extending direction of the electric wire is less than 25 deg. or exceeds 35 deg., the first opening edges of the recesses adjacent to each other in the extending direction of the electric wire do not overlap with respect to the extending direction of the electric wire in some area. Therefore, such an angle is unsuitable.

Furthermore, the crimping portion is crimped onto the core wire in the binding manner. Therefore, the opening edges of the recesses deform in a direction to close with respect to the direction crossing the extending direction of the core wire.

Therefore, if the angle between each second inclined surface and the bottom surface of the recess is too small, the opening edge of the recess is closed and occupied with respect to the direction crossing the extending direction of the core wire. Then, scraping contact of the second opening edge with the core wire can become impossible.

Considering these points, the angle between each second inclined surface and the surface that is the part of the surface of the wire barrel to be applied to the core wire, the part having none of the recesses, should be from 115 deg. to 140 deg. This can suppress closing and occupation of the opening edge of the recess in the direction crossing the extending direction of the core wire. As a result of this, the second opening edge can come into scraping contact with the core wire to remove the oxide layer of the core wire.

Thus, the present invention makes it possible to reduce the electrical resistance between the electric wire and the terminal connector, while reducing the cost of manufacturing the die.

EXPLANATION OF REFERENCE CHARACTERS

Figure 1:
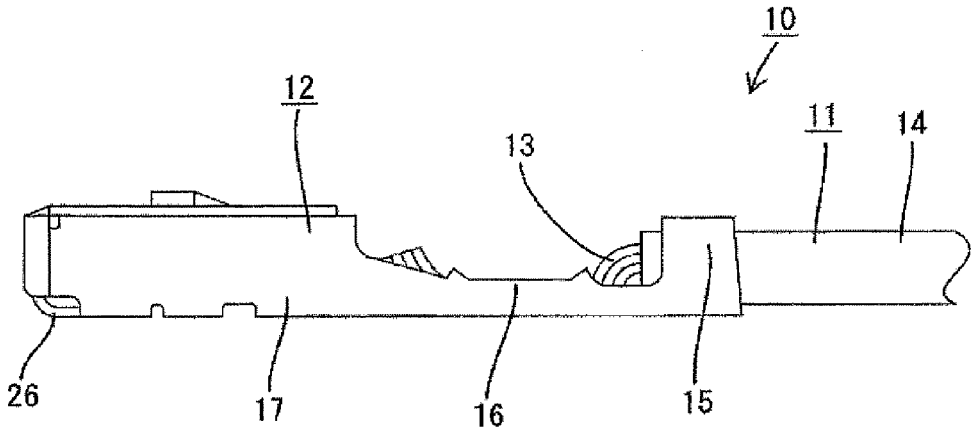
FIG. 1 is a side view illustrating an electric wire with a terminal connector in accordance with the present invention.

10 . . . electric wire with terminal connector
11 . . . electric wire
12 . . . female terminal connector (terminal connector)
13 . . . core wire
16 . . . wire barrel (crimping portion)
17 . . . connecting portion
18 . . . recess
19 . . . first opening edge
20 . . . second opening edge
22 . . . first inclined surface
23 . . . second inclined surface

BEST MODE FOR CARRYING OUT THE INVENTION

First Embodiment

A first embodiment in accordance with the present invention will be described with reference to FIGS. 1 through 9. As illustrated in FIG. 1, this embodiment illustrates an electric wire with a terminal connector 10. The terminal connector 10 includes an electric wire 11 and a female terminal connector 12. A core wire 13 is exposed at an end of the electric wire 11. The female terminal connector 12 is crimped on the core wire 13.

(Electric Wire 11)

As illustrated in FIG. 1, the electric wire 11 includes the core wire 13 and a wire insulation 14. The core wire 13 is made by stranding a plurality of metal threads. The wire insulation 14 is made of insulating synthetic resin. The wire insulation 14 encloses the outer periphery of the core wire 13. Aluminium or aluminium alloy can be used as the metal threads. In this embodiment, aluminium alloy is used as the metal threads. As illustrated in FIG. 1, the wire insulation 14 is removed at the end of the electric wire 11 so that the core wire 13 is exposed.

(Female Terminal Connector 12)

Figure 3:
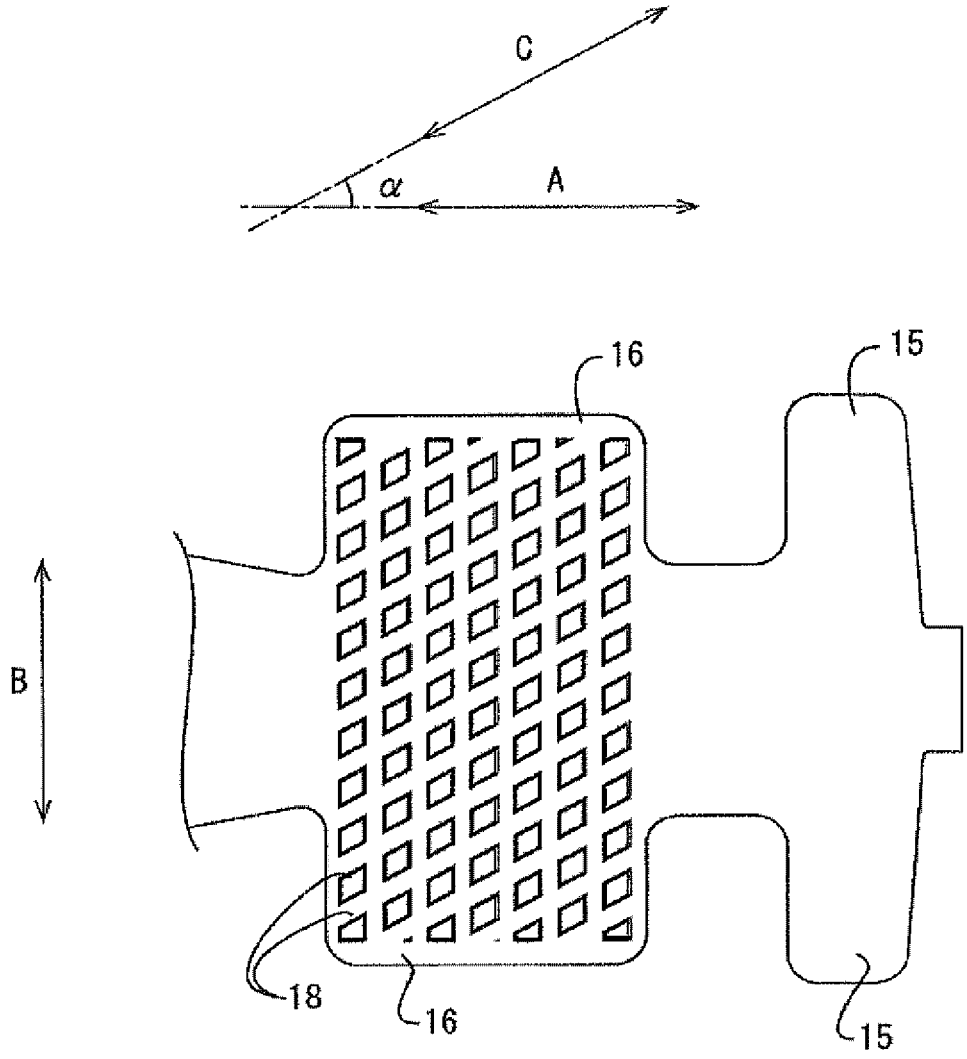
FIG. 3 is an enlarged plan view of a main part, illustrating the male terminal connector in a developed state.

The female terminal connector 12 is formed by pressing a metal plate into a predetermined shape. The female terminal connector 12 includes an insulation barrel 15, a wire barrel 16 (corresponding to a crimping portion described in the claims), and a connecting portion 17. The insulation barrel 15 is crimped on the outer periphery of the wire insulation 14 of the electric wire 11 in a binding manner. The wire barrel 16 extends from the insulation barrel 15. The wire barrel 16 is crimped on the core wire 13 in a binding manner. The connecting portion 17 extends from the wire barrel 16. The connecting portion 17 is connected to a male terminal connector, not shown. As illustrated in FIG. 3, the insulation barrel 15 is shaped like a pair of plates protruding upward and downward.

Figure 2:
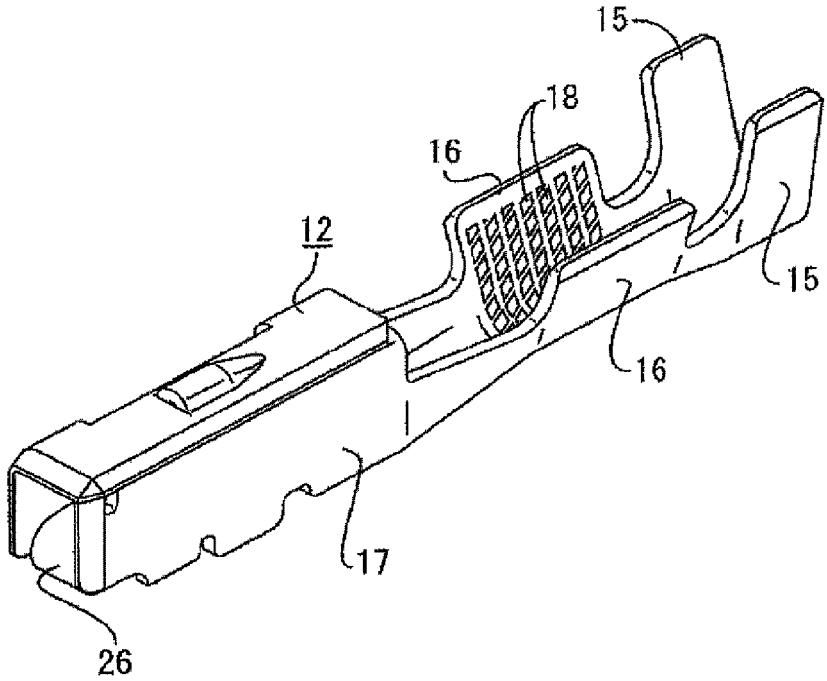
FIG. 2 is a perspective view illustrating a female terminal connector.

As illustrated in FIG. 2, the connecting portion 17 is tubular to allow a male tab (not shown) of the male terminal connector to be inserted therein. The connecting portion 17 has an elastic contact piece 26 formed therein. The elastic contact piece 26 can elastically contact with the male tab of the male terminal connector so that the female terminal connector 12 comes into electrical connection with the male terminal connector.

In this embodiment, the female terminal connector 12 is the female terminal connector 12 having the tubular connecting portion 17. Note that it is not limited to this; it may be a male terminal connector having a male tab or an LA terminal having a metal plate with an open hole. The terminal connector may have any shape upon as necessary.

(Wire Barrel 16)

An enlarged plan view of a main part of the wire barrel 16 in a developed state is illustrated in FIG. 3. As illustrated in FIG. 3, the wire barrel 16 is shaped like a pair of plates protruding upward downward in FIG. 3. In a state before being crimped onto the electric wire, the wire barrel 16 is substantially rectangular as viewed from a direction penetrating the sheet of FIG. 3.

As illustrated in FIG. 3, the wire barrel 16 has a plurality of recesses 18 in a surface (in the surface on the nearer side as viewed from a direction penetrating the sheet of FIG. 3) which is to be applied onto the electric wire 11 when the wire barrel 16 is crimped onto the electric wire 11. In the state before being crimped onto the electric wire 11, the opening edge of each recess 18 is parallelogram-shaped as viewed from the direction penetrating the sheet of FIG. 3.

The parallelogram that forms the opening edge of each recess 18 includes a pair of first opening edges 19 and a pair of second opening edges 20. Each of the first opening edges 19 crosses the extending direction (the direction illustrated by arrow A in FIG. 3) of the core wire 13 at an angle from 85 deg. to 95 deg. in the state where the wire barrel 16 is crimped on the core wire 13. Each of the second opening edges 20 crosses the extending direction (the direction illustrated by arrow A in FIG. 3) of the core wire 13 at an angle from 25 deg. to 35 deg. In this embodiment, the first opening edge 19 is at right angles to the extending direction of the core wire 13. In this embodiment, the length of the first opening edge 19 is 0.25 mm. In addition, the second opening edge 20 crosses the extending direction of the core wire 13 at an angle of 30 deg.

As illustrated in FIG. 3, the recesses 18 are spaced in the extending direction of the first opening edges 19, i.e. in the direction (in the direction illustrated by arrow B in FIG. 3) at right angles to the extending direction of the core wire 13 (to the direction illustrated by arrow A in FIG. 3). The first opening edges 19 of the recesses 18 adjacent to each other are aligned in the extending direction of the first opening edges 19.

As illustrated in FIG. 3, the recesses 18 are spaced in the extending direction of the second opening edges 20, i.e. in the direction at an angle $\alpha$ from 25 deg. to 35 deg. to the extending direction of the core wire 13 (to the direction illustrated by arrow A in FIG. 3). In this embodiment, the recesses 18 are spaced in a direction (in the direction illustrated by arrow C in FIG. 3) at an angle $\alpha$ of 30 deg. to the extending direction of the core wire 13. The second opening edges 20 of the recesses 18 adjacent to each other are aligned in the extending direction of the second opening edges 20.

As illustrated in FIG. 3, at least one of the first opening edges 19 is disposed with respect to the extending direction of the core wire 13 (with respect to the direction illustrated by arrow A in FIG. 3) on the surface, which is to be applied onto the core wire 13, of the wire barrel 16.

Figure 4:
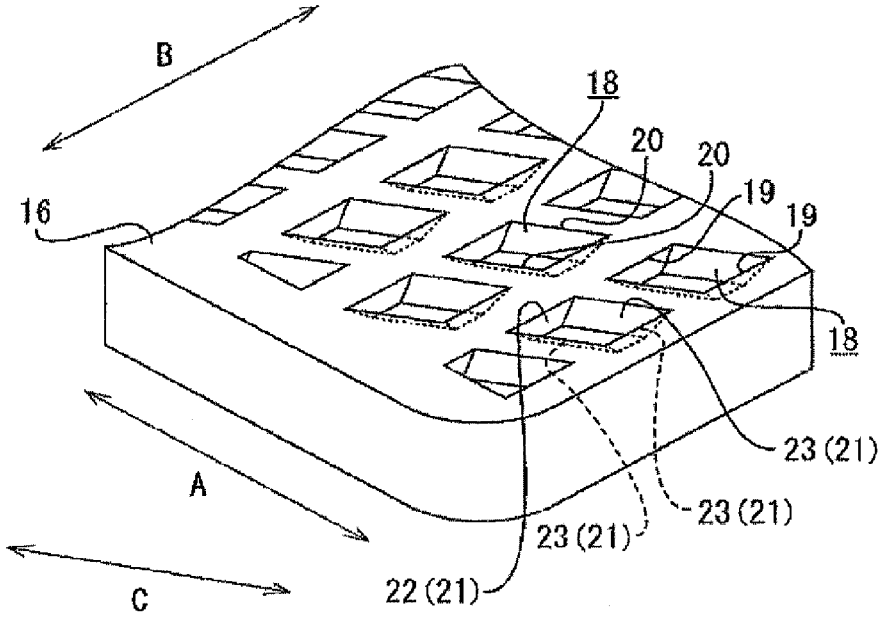
FIG. 4 is an enlarged perspective view of a main part, illustrating recesses formed in a wire barrel.

As illustrated in FIGS. 3 and 4, the bottom surface of each recess 18 is shaped similar to the opening edge of the recess 18 while is slightly smaller than the opening edge of the recess 18. Thus, the bottom surface of the recess 18 and the opening edge of the recess 18 are connected together by four inclined surfaces 21 that are wider from the bottom surface of the recess 18 toward the opening edge of the recess 18.

Figure 5:
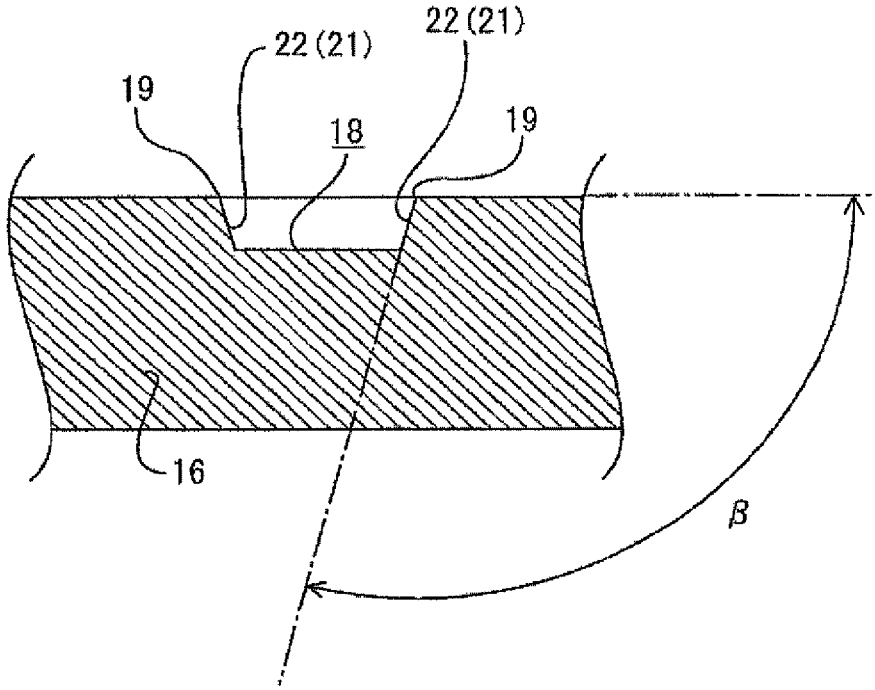
FIG. 5 is a sectional view along line V-V in FIG. 7.

As illustrated in FIG. 5, the inclined surfaces 21 includes first inclined surfaces 22 that connect the respective first opening edges 19 with the bottom surface of the recess 18. Each first inclined surface 22 has an angle β from 90 deg. to 110 deg. to the surface that is the part of the surface of the wire barrel 16 to be applied to the core wire 13, the part having no recess 18. In this embodiment, the first inclined surface 22 has the angle β of 105 deg.

Figure 6:
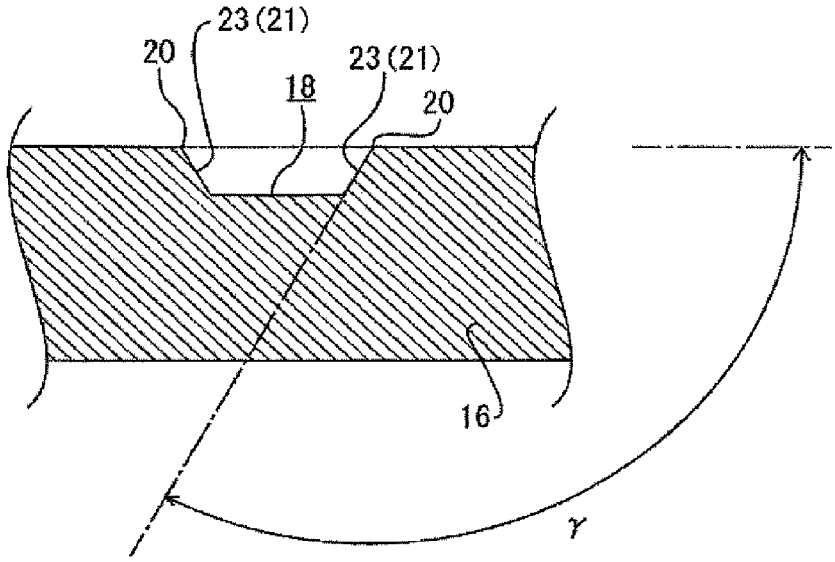
FIG. 6 is a sectional view along line VI-VI in FIG. 7.

As illustrated in FIG. 6, the inclined surfaces 21 includes second inclined surfaces 23 that connect the respective second opening edges 20 with the bottom surface of the recess 18. Each second inclined surface 23 has an angle γ from 115 deg. to 140 deg. to the surface that is the part of the surface of the wire barrel 16 to be applied to the core wire 13, the part having no recess 18. In this embodiment, the second inclined surface 23 has the angle γ of 120 deg.

Figure 7:
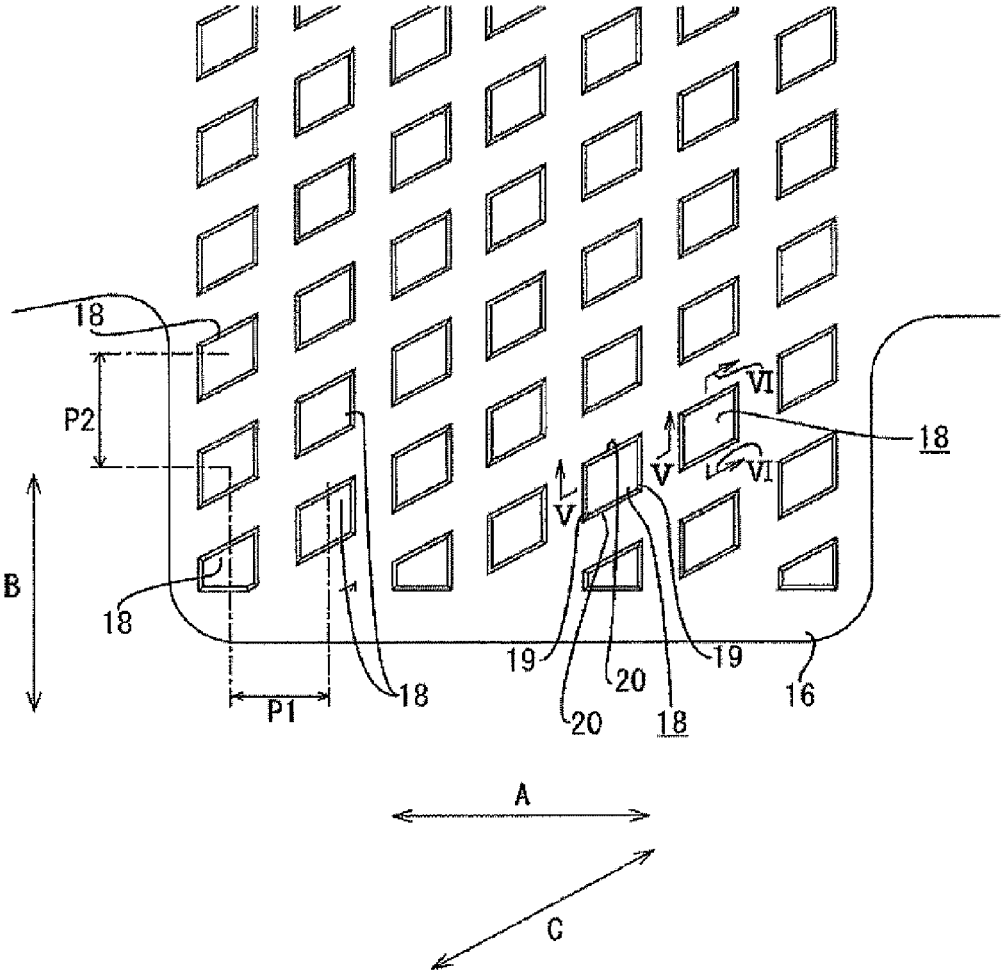
FIG. 7 is an enlarged plan view of a main part, illustrating the recesses formed in the wire barrel.

Furthermore, as illustrated in FIG. 7, the recesses 18 are arranged in rows in the direction (in the direction illustrated by arrow C) at the angle of 30 deg. to the extending direction of the core wire 13 (to the direction illustrated by arrow A in FIG. 7). The recesses 18 in each of these rows are spaced at a first pitch distance (P1 in FIG. 7) with respect to the extending direction of the core wire 13 (to the direction illustrated by arrow A). The first pitch distance is set at from 0.3 mm to 0.8 mm. In this embodiment, the first pitch distance is set at 0.4 mm. Furthermore, the recesses 18 are arranged in rows in the direction (in the direction illustrated by arrow B) at right angles to the extending direction of the core wire 13 (to the direction illustrated by arrow A). The recesses 18 in each of these rows are spaced at a second pitch distance (P2 in FIG. 7) with respect to the direction (in the direction illustrated by arrow B) at right angles to the extending direction of the core wire 13 (to the direction illustrated by arrow A). The second pitch distance is set at from 0.3 mm to 0.8 mm. In this embodiment, the second pitch distance is set at 0.5 mm.

In this embodiment, where the percentage of the cross section of the core wire 13 after being crimped by the wire barrel 16 to the cross section of the core wire 13 before being crimped by the wire barrel 16 is a compression rate of the core wire 13 crimped by the wire barrel 16, the compression rate is from 40 percent to 70 percent. In this embodiment, the compression rate is 60 percent.

Next, operations and effects of this embodiment will be described. Following is an illustration of a process of attaching the female terminal connector 12 to the electric wire 11. First, the metal plate is press molded into a predetermined shape. Forming the recesses 18 may be done concurrently with this.

The metal plate formed in the predetermined shape is, next, bent to form the connecting portion 17 (see FIG. 2). Forming the recesses 18 may be done concurrently with this.

Figure 8:
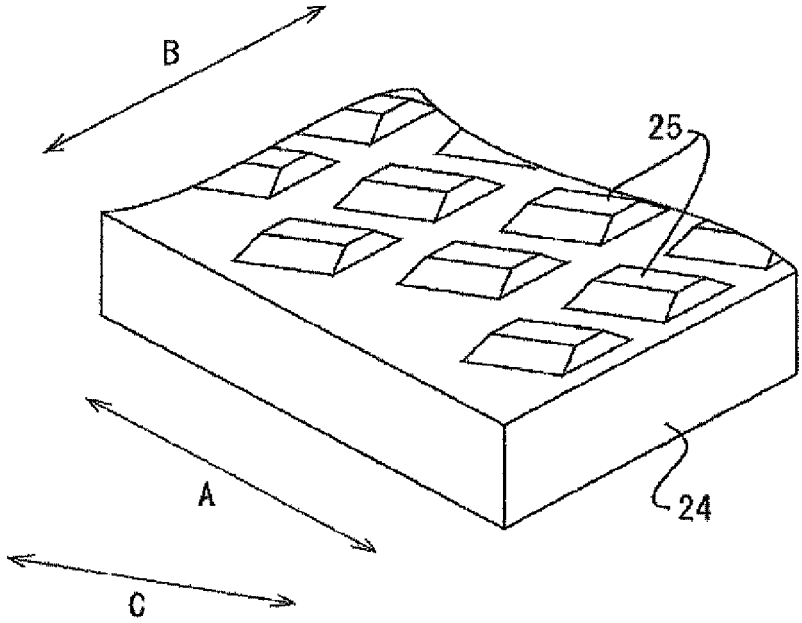
FIG. 8 is an enlarged perspective view of a main part of a die for press molding the female terminal connector.

As illustrated in FIG. 8, a die 24 for press molding the female terminal connector 12 has a plurality of protrusions 25 formed at positions corresponding to the respective recesses 18 of the wire barrel 16.

As illustrated in FIG. 4, the recesses 18 in the wire barrel 16 are spaced in the extending direction of the first opening edges 19 (in the direction illustrated by arrow B) and, furthermore, are spaced in the extending direction of the second opening edges 20 (in the direction illustrated by arrow C). Therefore, as illustrated in FIG. 8, the protrusions 25, which are formed at the positions corresponding to the respective recesses 18, of the die 24 are spaced in the extending direction of the first opening edges 19 (in the direction illustrated by arrow B) and, furthermore, are spaced in the direction (in the direction illustrated by arrow C) at the angle α of 30 deg. to the extending direction of the core wire 13. Furthermore, the first opening edges 19 of the recesses 18 are aligned in the extending direction of the first opening edges 19 (in the direction illustrated by arrow B); and the second opening edges 20 of the recesses 18 are aligned in the extending direction of the second opening edges 20 (in the direction illustrated by arrow C).

Therefore, as illustrated in FIG. 7, the surface, which is applied on the electric wire 11, of the wire barrel 16 has areas that differ from areas corresponding to the respective recesses 18. The areas extend in strips in the extending direction of the first opening edges 19 (in the direction illustrated by arrow B) and, furthermore, in strips in the extending direction of the second opening edges 20 (in the direction illustrated by arrow C).

Therefore, in order to form the spaced protrusions 25, the protrusions 25 can be manufactured by cutting a plurality of grooves that extend in strips in the extending direction of the first opening edges 19 and, further, by cutting a plurality of grooves that extend in strips in the extending direction of the second opening edges 20, while leaving the protrusions 25 on the metal part. Thus, the die 24 for press molding the female terminal connector 12 of this embodiment can be manufactured by cutting work.

Next, the wire insulation 14 of the electric wire 11 is removed to expose the core wire 13. The core wire 13 is placed on the wire barrel 16, while the wire insulation 14 is placed on the insulation barrel 15. In this state, both barrels 15, 16 are crimped onto the outside of the electric wire 11 with the die, not shown.

Figure 9:
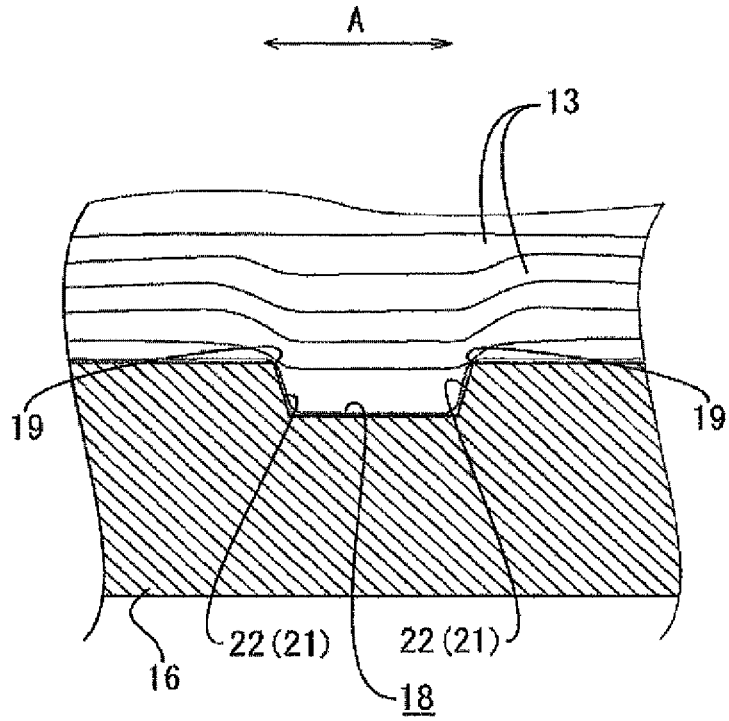
FIG. 9 is an enlarged sectional view of a main part illustrating a state in which the wire barrel is crimped on a core wire.

As illustrated in FIG. 9, when the wire barrel 16 is crimped onto the core wire 13, the core wire 13 elastically deforms to lengthen in the extending direction of the core wire 13 (in the direction illustrated by arrow A in FIG. 9) under the pressure of the wire barrel 16. Then, the outer periphery of the core wire 13 comes into scraping contact with the opening edges of the recesses 18. This removes the oxide layer on the outer periphery of the core wire 13, so that the new surface of the core wire 13 is exposed. The new surface and the wire barrel 16 comes into contact with each other, so that the core wire 13 and the wire barrel 16 come into electrical connection to each other.

Furthermore, in accordance with this embodiment, relatively great stress toward the core wire 13 is gathered in the areas, which are located between the recesses 18, of the wire barrel 16. Thus, the opening edges of the recesses 18 can remove the oxide layer on the surface of the core wire 13 to expose the new surface of the core wire 13.

Furthermore, in accordance with this embodiment, the first opening edges 19 cross the extending direction of the core wire 13 at the angle from 85 deg. to 95 deg. Therefore, when a force in the extending direction of the electric wire 11 is applied to the core wire 13 in the state crimped by the wire barrel 16, the edges of the first opening edges 19 suppress the movement of the core wire 13. This ensures contact of the new surface, which is formed by the scraping contact with the first opening edges 19 and the second opening edges 20 of the recesses 18, of the core wire 13 with the surface near the recesses 18 of the wire barrel 16. As a result of this, the electrical resistance between the electric wire 11 and the female terminal connector 12 can surely be reduced.

On the other hand, if the angle between the first opening edges 19 and the extending direction of the core wire 13 is less than 85 deg. or exceeds 95 deg., retaining the movement of the core wire 13 by the edges of the first opening edges 19 can be insufficient when the force is applied in the extending direction of the electric wire 11 to the core wire 13. Then, the core wire 13 can be forced to move in the direction away from the surface of the wire barrel 16. This causes the new surface of the core wire 13 to partially lose the electrical connection with the wire barrel 16. As a result of this, reduction in the electrical resistance between the electric wire 11 and the female terminal connector 12 can be insufficient. Therefore, such an angle is unsuitable.

Furthermore, each first inclined surface 22, which connects the corresponding first opening edge 19 of the recess 18 with the bottom surface of the recess 18, has an angle β from 90 deg. to 110 deg. to the surface that is the part of the surface of the wire barrel 16 to be applied to the core wire 13, the part having no recess 18. As described above, the recesses 18 are formed by pressing the protrusions 25 of the die 24 into the metal plate. Therefore, for easier removal of the protrusions 25 of the die 24 after the pressing work, each inclined surface 21 between the opening edge of each recess 18 and the bottom surface of the recess 18 is wider from the bottom surface of the recess 18 toward the opening edge of the recess 18. In other words, the inclined surface 21 has a right angle or an obtuse angle to the surface of the wire barrel 16 to be applied to the core wire 13.

The greater the angle between the inclined surface 21 and the surface of the wire barrel 16 to be applied to the core wire 13 is, the gentler the edge of the opening edge of the recess 18 is. In this embodiment, the angle β between the first inclined surface 22 and the surface of the wire barrel 16 to be applied to the core wire 13 is from 90 deg. 110 deg. (105 deg. in this embodiment), i.e. is relatively small as the right angle or the obtuse angle. Accordingly, the edge of each first opening edge 19 of the recess 18 is relatively sharp. As a result of this, the edge of the first opening edge 19 digs into the core wire 13 so as to surely remove the oxide layer on the core wire 13.

On the other hand, each second opening edges 20 have the angle α from 25 deg. to 35 deg. (30 deg. in this embodiment) to the extending direction of the core wire 13. Because of this, the first opening edges 19 of the recesses 18 adjacent to each other in the extending direction of the electric wire 11 overlap with respect to the extending direction of the electric wire 11. This provides still further improvement in the retention force of the wire barrel 16 on the core wire 13. If the angle α between the second opening edges 20 and the extending direction of the electric wire 11 is less than 25 deg. or exceeds 35 deg., the first opening edges 19 of the recesses 18 adjacent to each other in the extending direction of the electric wire 11 do not overlap with respect to the extending direction of the electric wire 11 in some area. Therefore, such an angle is unsuitable.

Furthermore, the wire barrel 16 is crimped onto the outside of the core wire 13 in the binding manner. Therefore, the opening edges of the recesses 18 deform in the direction (in the direction illustrated by arrow B in FIG. 3) to close with respect to the direction at right angles to the extending direction of the core wire 13.

Therefore, if the angle γ between the second inclined surface 23 and the surface of the wire barrel 16 to be applied to the core wire 13 is too small, the opening edge of the recess 18 is closed and occupied with respect to the direction at right angles to the extending direction of the core wire 13. Then, scraping contact of the second opening edge 20 with the core wire 13 can become impossible.

However, on the other hand, if the angle γ between the second inclined surface 23 and the surface that is the part of the surface of the wire barrel 16 to be applied to the core wire 13, the part having no recess 18, is set to be greater, the edge of the second opening edge 20 becomes gentler. This possibly causes difficulty in digging into the core wire 13 by the second opening edge 20 and difficulty in removing the oxide layer on the core wire 13.

Considering these points, in this embodiment, the angle γ between the second inclined surface 23 and the surface that is the part of the surface of the wire barrel 16 to be applied to the core wire 13, the part having no recess 18, is set at 120 deg. This can suppress closing and occupation of the opening edge of the recess 18 in the direction at right angles to the extending direction of the core wire 13 even when the wire barrel 16 is crimped onto the core wire 13, while providing a relatively sharp edge of the second opening edge 20. As a result of this, the edge of the second opening edge 20 can dig into the core wire 13 and thereby remove the oxide layer of the core wire 13.

Furthermore, in accordance with this embodiment, the recesses 18 are spaced at the first pitch distance P1 from 0.3 mm to 0.8 mm, i.e. at a relatively small pitch distance, with respect to the extending direction of the electric wire 11. This increases the number, per unit area, of the recesses 18. This increases the area, per unit area, of the edges of the opening edges of the recesses 18. This relatively increases the area, per unit area, in which the edges of the opening edges of the recesses 18 bite into the core wire 13. This provides improvement in the retention force of the wire barrel 16 on the core wire 13.

Furthermore, in accordance with this embodiment, the recesses 18 are spaced at the second pitch distance P2 from 0.3 mm to 0.8 mm, i.e. at a relatively small pitch distance, with respect to the direction (with respect to the extending direction of the first opening edges 19) at right angles to the extending direction of the electric wire 11. This increases the number, per unit area, of the recesses 18. This increases the area, per unit area, of the edges of the opening edges of the recesses 18. This relatively increases the area, per unit area, in which the edges of the opening edges of the recesses 18 bite into the core wire 13. This provides improvement in the retention force for the core wire 13 by the wire barrel 16.

Furthermore, in this embodiment, the die 24 can be formed by cutting work. Therefore, the manufacturing cost can be lower than forming the die 24 by electrical-discharge machining work.

Furthermore, in accordance with this embodiment, the length of each first opening edge is set at 0.25 mm or at from 0.2 to 0.4 mm. This makes the first opening edges 19 of the recesses 18 in the wire barrel 16 to bite into the outer periphery of the core wire 13. This ensures retention of the core wire 13 in the wire barrel 16. If the length of the first opening edge 19 is less than 0.2 mm., the retention force for the core wire 13 by the wire barrel 16 is lower. Therefore, such a length is unsuitable. Furthermore, if the length of the first opening edge 19 exceeds 0.4 mm, the space between the recesses 18 adjacent to each other with respect to the extending direction of the first opening edges 19 becomes narrower. Then, the protrusions 25 of the die 24 can be broken off, when the recesses 18 are being formed. Therefore, such a length is unsuitable.

In this embodiment, the core wire 13 includes aluminium alloy. If the core wire 13 includes aluminium alloy as in this embodiment, the oxide layer is formed with relative ease on the surface of the aluminium or aluminium alloy. This embodiment makes it possible to reduce the electrical resistance between the electric wire 11 and the female terminal connector 12 even if the core wire 13 includes aluminium alloy.

Furthermore, in order to break the oxide layer on the surface of the core wire 13 to reduce the electrical resistance, the wire barrel 16 needs to be crimped onto the core wire 13 at a relatively low compression rate. In accordance with this embodiment, the wire barrel 16 is crimped onto the electric wire 11 at a relatively low compression rate such as from 40 percent to 70 percent. This makes it possible to effectively remove the oxide layer on the surface of the core wire 13. The compression rate can be changed as desired within the above-described range. For example, the compression rate may be from 50 percent to 60 percent or, if the core wire 13 of the electric wire 11 is larger in cross section, the compression rate may be from 40 percent to 50 percent. Note that the compression rate is defined as follows: {(cross section of core wire after compression)/(cross section of core wire before compression)}*100.

The technique described in the specification will hereinafter be described on the basis of examples. Note that the technique described in the specification is not limited to the examples as follows whatever.

Example 1-1

First, a die having protrusions in predetermined shape was made by cutting a plurality of grooves in a metal part. Using this die, a terminal connector was made by pressing and bending a metal plate made of copper alloy with a tinned surface. The metal plate was 0.25 mm thick.

The configuration etc. of the recesses formed in the wire barrel of the terminal connector was as follows: 85 deg. between the first opening edges and the extending direction of the electric wire; 30 deg. between the second opening edges and the extending direction of the electric wire; 105 deg. between each first inclined surface and the surface that is the part of the surface of the wire barrel to be applied to the core wire, the part having no recess; 120 deg. between each second inclined surface and the surface that is the part of the surface of the wire barrel to be applied to the core wire, the part having no recess; and 0.4 mm pitch distance of the recesses adjacent to each other in the extending direction of the electric wire (the core wire) and 0.5 mm pitch distance in the extending direction of the first opening edges.

On the other hand, the wire insulation at the end of the electric wire was removed so that the aluminium alloy core wire was exposed. The cross section of the core wire was 0.75 $mm^2$. Thereafter, the wire barrel was crimped onto the exposed core wire. The compression rate of the core wire was 60 percent.

Examples 1-2 and 1-3

In Example 1-2, the angle between the first opening edges and the extending direction of the electric wire was set at 90 deg. In Example 1-3, the angle between the first opening edges and the extending direction of the electric wire was set at 95 deg. The other configuration in making the electric wire with the terminal connector of Examples 1-2 and 1-3 was identical with that of Example 1-1.

Comparative Examples 1-1 through 1-4

In Comparative Examples 1-2 through 1-4, the electric wire with the terminal connector was set so as to have the angle shown in Table 1 between the first opening edge and the extending direction of the electric wire. The other configuration in making the electric wire with the terminal connector was identical with that of Example 1-1.

The electric wire with the terminal connector made as above was subjected to determination of the fastening force (retention force) between the electric wire and the terminal connector. Furthermore, the electric wire with the terminal connector was subjected to determination of the electrical resistance between the core wire and the terminal connector.

(Electrical Resistance Determination and Fastening Force Determination)

Heating up to 125 deg. C. for 0.5 hours and cooling down to −40 deg. C. for 0.5 hours was repeated on the electric wire with the terminal connector for 250 cycles, thereby load due to thermal expansion on the connecting portion between the core wire and the wire barrel was repetitively applied.

Determination of the electrical resistance between the terminal connector and the core wire of was made on the above items. The determination was made on 20 samples. The averages are shown in Table 1.

Thereafter, the terminal connector and the electric wire were held with respective tools, and a tensile test was made. The rate of pulling was 100 mm/sec. The stress at the moment when the electric wire was broken away from the wire barrel of the terminal connector was taken as the value of fastening force. The test was made on 10 samples. The averages are shown in Table 1.

TABLE 1

| | ANGLE BETWEEN FIRST OPENING EDGE AND EXTENDING DIRECTION OF ELECTRIC WIRE (°) | FASTENING FORCE (N) | RESISTANCE (mΩ) |
|---|---|---|---|
| COMPARATIVE EXAMPLE 1-1 | 45 | 50 | 1.2 |
| COMPARATIVE EXAMPLE 1-2 | 75 | 55 | 1.2 |
| EXAMPLE 1-1 | 85 | 63 | 0.4 |
| EXAMPLE 1-2 | 90 | 65 | 0.5 |
| EXAMPLE 1-3 | 95 | 63 | 0.4 |
| COMPARATIVE EXAMPLE 1-3 | 105 | 55 | 1.2 |
| COMPARATIVE EXAMPLE 1-4 | 135 | 50 | 1.2 |

As shown in Table 1, in Comparative Examples 1-1 and 1-2 with the angle less than 85 deg. between the first opening edge and the extending direction of the electric wire, the electrical resistance between the core wire and the terminal connector was 1.2 mΩ. On the other hand, in Comparative Examples 1-3 and 1-4 with the angle greater than 95 deg. between the first opening edge and the extending direction of the electric wire, The electrical resistance between the core wire and the terminal connector was 1.2 mΩ.

On the other hand, in Examples 1-1 and 1-3 with the angle from 85 deg. to 95 deg. between the first opening edge and the extending direction of the electric wire, the electrical resistance between the core wire and the terminal connector was 0.5 mΩ. Thus, the electric wire with the terminal connector of Examples 1-1 through 1-3 provided as great as 58 percent reduction in the electrical resistance between the core wire and the terminal connector relative to the electric wire with the terminal connector of Comparative Examples 1-1 through 1-4.

In Examples 1-1 through 1-3, the first opening edges cross at an angle from 85 deg. to 95 deg. to the extending direction of the core wire. This makes the edge of the first opening edges suppress the movement of the core wire when the force in the extending direction of the electric wire due to bending of the electric wire is applied to the core wire in the state crimped by the wire barrel. This ensures contact of the new surface, which is formed by the scraping contact with the first opening edges of the recess, of the core wire with the surface near the recess of the wire barrel. This conceivably ensured reduction in the electrical resistance between the core wire and the terminal connector.

On the other hand, in Comparative Examples 1-1 and 1-2, the angle between the first opening edges and the extending direction of the core wire was less than 85 deg. while, in Comparative Examples 1-3 and 1-4, the angle between the first opening edges and the extending direction of the core wire exceeded 95 deg. This conceivably caused insufficient retention of the movement of the core wire by the edge of the first opening edge when the force in the extending direction of the electric wire is applied to the core wire. Then, the core wire was forced to move in the direction away from the surface of the wire barrel. This caused the new surface of the core wire to partially lose the electrical connection with the crimping portion. This conceivably caused the insufficient reduction in the electrical resistance between the electric wire and the terminal connector.

On the other hand, referring to the fastening force, in the Comparative Examples 1-1 through 1-4, the fastening force between the electric wire and the terminal connector was less than 55 N.

On the other hand, in Examples 1-1 through 1-3, the fastening force between the electric wire and the terminal connector was greater than 63 N. Thus, the angle from 85 deg. to 95 deg. between the first opening edges and the extending direction of the electric wire provided as great as 15 percent improvement in the fastening force between the electric wire and the terminal connector. In particular, in Example 1-2 with the angle of 90 deg. between the first opening edges and the extending direction of the electric wire, the fastening force was 65 N. From this result, the angle between the first opening edges and the extending direction of the electric wire should be 90 deg.

In Examples 1-1 through 1-3, the first opening edges cross at the angle from 85 deg. to 95 deg. to the extending direction of the core wire. This makes the edges of the first opening edges retain the core wire to suppress the movement of the core wire when the force is applied in the extending direction of the electric wire to the core wire in the state crimped by the wire barrel. This conceivably provided the improvement in the fastening force between the electric wire and the terminal connector.

Examples 2-1 through 2-3 and Comparative Example 2-1

The angle between the first opening edges and the extending direction of the electric wire was set at 90 deg., while the angle between the second opening edges and the extending direction of the electric wire was set at the value shown in Table 2. The other configuration in making the electric wire with terminal connector was identical with that of Example 1.

Comparative Example 2-2

The die was made with the angle of 45 deg. between the second opening edges and the extending direction of the electric wire, and the metal plate was pressed. Then, the protrusions of the die were broken off, and thus, no terminal connector could be made.

In Examples 2-1 and 2-3 and in Comparative Example 2-1, determination of the fastening force and the electrical resistance were made in the manner identical with Example 1. The result is shown in Table 2.

TABLE 2

| | ANGLE BETWEEN SECOND OPENING EDGE AND EXTENDING DIRECTION OF ELECTRIC WIRE (°) | FASTENING FORCE (N) | RESISTANCE (mΩ) |
|---|---|---|---|
| COMPARATIVE EXAMPLE 2-1 | 0 | 45 | 1.5 |
| EXAMPLE 2-1 | 25 | 62 | 0.5 |
| EXAMPLE 2-2 | 30 | 65 | 0.5 |
| EXAMPLE 2-3 | 35 | 65 | 0.5 |
| COMPARATIVE EXAMPLE 2-2 | 45 | — | — |

As shown in Table 2, in Comparative Example 2-1 (the electric wire with the terminal connector having the angle of 0 deg. between the second opening edges and the extending direction of the electric wire), the fastening force (the retention force) between the electric wire and the terminal connector was 45 N.

On the other hand, in Examples 2-1 through 2-3 (the electric wire with the terminal connector having the angle from 25 deg. to 35 deg. between the second opening edges and the extending direction of the electric wire), the fastening force between the electric wire and the terminal connector was 62 N or greater. Thus, the electric wire with the terminal connector of Examples 2-1 and 2-3 provided as great as 38 percent improvement in the fastening force between the electric wire and the terminal connector relative to the electric wire with the terminal connector of Comparative Example 2-1.

In Examples 2-1 through 2-3 (the electric wire with the terminal connector having the angle from 25 deg. to 35 deg. between the second opening edges and the extending direction of the electric wire), the first opening edges of the recesses adjacent to each other in the extending direction of the electric wire overlap with respect to the extending direction of the electric wire (see FIG. 7). This ensured existence of the area, in which the edge of the first opening edge of the recess bites into the core wire, with respect to the extending direction of the electric wire. This conceivably provided the still further improvement in the retention force of the wire barrel on the core wire.

On the other hand, in Comparative Example 2-1 with the angle of 0 deg. between the second opening edges and the extending direction of the electric wire, the first opening edges of the recesses adjacent to each other in the extending direction of the electric wire conceivably did not overlap with respect to the extending direction of the electric wire in some area. This conceivably caused the fastening force of 45 N, which is relatively low, between the electric wire and the terminal connector.

Furthermore, forming the recess with the angle of 45 deg. between the second opening edge and the electric wire was impossible due to breaking off of the die at the time of pressing the metal plate.

Furthermore, while the electric wire with the terminal connector of Comparative Example 2-1 showed the electrical resistance of 1.5 mΩ between the core wire and the terminal connector, the electric wire with the terminal connector of Examples 2-1 through 2-3 showed the electrical resistance of 0.5 mΩ, i.e. provided as great as 67 percent reduction in the electrical resistance relative to Comparative Example 2-1.

Examples 3-1 through 3-3 and Comparative Examples 3-1 and 3-2

The angle between the first opening edges and the extending direction of the electric wire was set at 90 deg. The angle between the first inclined surface and the surface that is the part of the surface of the wire barrel to be applied to the core wire, the part having no recess, (the angle is hereinafter referred to also as the "first inclined surface angle") was set at the value shown in Table 3. The other configuration in making the electric wire with the terminal connector was identical with that of Example 1.

When the first inclined surface angle was less than 90 deg., the first inclined surface angle overhung. Accordingly, press wording was impossible for making the terminal connector.

Examples 3-1 through 3-3 and Comparative Examples 3-1 and 3-2 were subjected to determination of the fastening force and the electrical resistance in the manner identical with Example 1. The result is shown in Table 3.

TABLE 3

| | FIRST INCLINED SURFACE ANGLE (°) | FASTENING FORCE (N) | RESISTANCE (mΩ) |
|---|---|---|---|
| EXAMPLE 3-1 | 95 | 65 | 0.5 |
| EXAMPLE 3-2 | 105 | 65 | 0.5 |
| EXAMPLE 3-3 | 110 | 62 | 0.5 |
| COMPARATIVE EXAMPLE 3-1 | 120 | 55 | 1.2 |
| COMPARATIVE EXAMPLE 3-2 | 125 | 51 | 1.4 |

As illustrated in Table 3, in Comparative Examples 3-1 and 3-2 with the first inclined surface angle exceeding 110 deg., the electrical resistance between the core wire and the terminal connector was 1.2 mΩ; while, in Examples 3-1 through 3-3 with the first inclined surface angle from 90 deg. to 110 deg., the electrical resistance between the core wire and the terminal connector was 0.5 ma. Thus, the electric wire with the terminal connector of Examples 3-1 through 3-3 provided as great as 58 percent reduction in the electrical resistance between the core wire and the terminal connector relative to the electric wire with the terminal connector of Comparative Examples 3-1 and 3-2.

The recesses are formed by pressing the protrusions of the die into the metal plate as described above. Therefore, for easier removal of the protrusions of the die after the pressing work, the first inclined surface angle is set at the right angle or the obtuse angle.

In Examples 3-1 through 3-3, the first inclined surface angle was set at from 90 deg. to 110 deg., i.e. at a relatively small angle as the right angle or the obtuse angle. This provided the relatively sharp edge of the first opening edge of the recess. Conceivably as a result of this, the edge of the first opening edge dug into the core wire, so that the oxide layer on the core wire was surely removed, and the new surface of the core wire and the terminal connector came into contact with each other. This conceivably provided the reduction in the electrical resistance between the core wire and the terminal connector.

On the other hand, in Comparative Examples 3-1 and 3-2, the angles formed by the first opening edges were 120 deg. and 125 deg., respectively, i.e. relatively great as the obtuse angles. This conceivably prevented the edge of the first opening edge from sufficiently biting into the core wire, resulting in insufficient reduction in the electrical resistance between the core wire and the terminal connector.

Furthermore, in Comparative Examples 3-1 and 3-2, the fastening force between the electric wire and the terminal connector was less than 55 N. On the other hand, in Examples 3-1 through 3-3, the fastening force between the electric wire and the terminal connector was greater than 62 N. Thus, the first inclined surface angle from 90 deg. to 110 deg. provided 13 percent improvement in the fastening force between the electric wire and the terminal connector.

Examples 4-1 through 4-4 and Comparative Examples 4-1 and 4-2

The angle between the first opening edge and the extending direction of the electric wire was set at 90 deg., while the angle between the second inclined surface and the surface that is the part of the surface of the wire barrel to be applied to the core wire, the part having no recess (hereinafter referred also as the "second inclined surface angle"), was set at the value shown in Table 4. The other configuration in making the electric wire with the terminal connector was identical with that of the Example 1.

Examples 4-1 through 4-4 and Comparative Examples 4-1 and 4-2 were subjected to determination of the fasting force and the electrical resistance in the manner identical with the Example 1. The result is shown in Table 4.

TABLE 4

| | SECOND INCLINED SURFACE ANGLE (°) | FASTENING FORCE (N) | RESISTANCE (mΩ) |
|---|---|---|---|
| COMPARATIVE EXAMPLE 4-1 | 105 | 57 | 1.4 |
| EXAMPLE 4-1 | 115 | 65 | 0.5 |
| EXAMPLE 4-2 | 120 | 65 | 0.5 |
| EXAMPLE 4-3 | 130 | 60 | 0.5 |
| EXAMPLE 4-4 | 140 | 55 | 0.7 |
| COMPARATIVE EXAMPLE 4-2 | 150 | 53 | 1.5 |

As shown in Table 4, in Comparative Example 4-1 with the second inclined surface angle of 105 deg., the electrical resistance between the core wire and the terminal connector was 1.4 mΩ. On the other hand, in Comparative Example 4-2 with the second inclined surface angle of 150 deg., the electrical resistance was 1.5 mΩ.

On the other hand, in Examples 4-1 through 4-4 with the second inclined surface angle from 115 deg. to 140 deg., the electrical resistance between the core wire and the terminal connector was less than 0.7 mΩ. Thus, the second inclined surface angle from 115 deg. to 140 deg. provided as great as 50 percent reduction in the electrical resistance between the core wire and the terminal connector. In addition, because the electrical resistance between the core wire and the terminal connector was 0.5 mΩ in Examples 4-1 through 4-3, the second inclined surface angle should be from 115 deg. to 130 deg.

The wire barrel is crimped onto the outside of the core wire in the binding manner. This deforms each recess in the inner periphery of the wire barrel so as to reduce the opening area of the opening edge portion of the recess when the wire barrel is crimped onto the core wire in the binding manner. At this time, if the second inclined surface angle is too small, the opening area of the opening edge portion of the recess becomes too small or, in some cases, closes. Then, conceivably, the scraping contact of the second opening edge of the recess with the core wire becomes impossible, which causes difficulty in exposing the new surface of the core wire. Conceivably for these reasons, the electrical resistance between the core wire and the terminal connector became 1.4 ma, i.e. relatively great, in Comparative Example 4-1.

On the other hand, if the second inclined surface angle is too great, the edge of the second opening edge is caused to be gentler. This can cause difficulties in digging into the core wire by the second opening edge 20, in removing the oxide layer on the core wire 13, and in exposing the new surface of the core wire. Conceivably for these reasons, the electrical resistance between the core wire and the terminal connector became 1.5 mΩ, i.e. relatively great, in Comparative Example 4-2.

With the second inclined surface angle from 115 deg. to 140 deg. of Examples 4-1 through 4-4, too small opening edge area of the opening edge portion of the recess and closure of the opening edge of the recess can be suppressed even when the wire barrel is crimped onto the core wire. Furthermore, the relatively sharp second opening edge can be provided. As a result of this, the edge of the second opening edge can dig into the core wire so as to remove the oxide layer of the core wire, thereby establishing contact between the new surface of the core wire and the terminal connector. This conceivably provide the reduction in the electrical resistance between the core wire and the terminal connector.

Examples 5-1 through 5-4 and Comparative Example 5-2

The angle between the first opening edge and the extending direction of the electric wire was set at 90 deg., while the first pitch distance of the plurality of recess with respect to the extending direction of the core wire was set at the value shown in Table 5. The other configuration in making the electric wire with the terminal connector was identical with that of Example 1.

Comparative Example 5-1

The die was made at 0.2 mm first pitch distance, and the metal plate was pressed. Then, the protrusions of the die were broken off, and thus, no terminal connector could be made.

Examples 5-1 through 5-4 and Comparative Example 5-2 were subjected to determination of the fasting force and the electrical resistance in the manner identical with Example 1. The result is shown in Table 5.

TABLE 5

| | PITCH DISTANCE (mm) | FASTENING FORCE (N) | RESISTANCE (mΩ) |
|---|---|---|---|
| COMPARATIVE EXAMPLE 5-1 | 0.2 | — | — |
| EXAMPLE 5-1 | 0.3 | 65 | 0.5 |
| EXAMPLE 5-2 | 0.4 | 65 | 0.5 |
| EXAMPLE 5-3 | 0.5 | 63 | 0.5 |
| EXAMPLE 5-4 | 0.8 | 60 | 0.8 |
| COMPARATIVE EXAMPLE 5-2 | 1.5 | 38 | 1.6 |

As shown in Table 5, in Comparative Example 5-2 with the recesses at 1.5 mm first pitch distance with respect to the extending direction of the core wire, the fastening force between the electric wire and the terminal connector was 38 N. On the other hand, in Examples 5-1 through 5-4 with the recesses at from 0.3 mm to 0.8 mm first pitch distance with respect to the extending direction of the core wire, the fastening force between the electric wire and the terminal connector was 60 N. Thus, the first pitch distance from 0.3 mm to 0.8 mm with respect to the extending direction of the core wire provided as great as 58 percent improvement in the fastening force between the electric wire and the terminal connector.

In Examples 5-1 through 5-4, the recesses were spaced at from 0.3 mm to 0.8 mm first pitch distance, i.e. at relatively small pitch distance, with respect to the extending direction of the electric wire. This increases the number, per unit area, of the recesses. This increases the area, per unit area, of the edges of the opening edges of the recesses. This increases the area, per unit area, in which the edges of the opening edges of the recesses bite into the core wire. As a result of this, the retention force of the wire barrel on the core wire is improved. This conceivably increased the fastening force between the electric wire and the terminal connector.

Furthermore, in Comparative Example 5-2, the electrical resistance between the core wire and the terminal connector was 1.2 mΩ. On the other hand, in Examples 5-1 through 5-4, the electrical resistance between the core wire and the terminal connector was 0.8 mΩ. Thus, the first pitch distance from 0.3 mm to 0.8 mm provided as great as 33 percent reduction in the electrical resistance between the core wire and the terminal connector. Furthermore, because the electrical resistance between the core wire and the terminal connector in Examples 5-1 through 5-3 was 0.5 mΩ, the first pitch distance should be from 0.3 m to 0.5 mm.

Examples 6-1 through 6-4 and Comparative Example 6-2

The angle between the extending direction of the electric wire and the first opening edge was set at 90 deg., while the first pitch distance of the plurality of recess with respect to the extending direction of the core wire was set at the value shown in Table 6. The other configuration in making the electric wire with the terminal connector was identical with that of Example 1.

Comparative Example 6-1

The die was made at 0.2 mm first pitch distance, and the metal plate was pressed. Then, the protrusions of the die were broken off, and thus, no terminal connector could be made.

Examples 6-1 through 6-4 and Comparative Example 6-2 were subjected to determination of the fasting force and the electrical resistance in the manner identical with Example 1. The result is shown in Table 6.

TABLE 6

| | PITCH DISTANCE (mm) | FASTENING FORCE (N) | RESISTANCE (mQ) |
|---|---|---|---|
| COMPARATIVE EXAMPLE 6-1 | 0.2 | — | — |
| EXAMPLE 6-1 | 0.3 | 68 | 0.5 |
| EXAMPLE 6-2 | 0.4 | 65 | 0.5 |
| EXAMPLE 6-3 | 0.5 | 65 | 0.5 |
| EXAMPLE 6-4 | 0.8 | 62 | 0.7 |
| COMPARATIVE EXAMPLE 6-2 | 1.5 | 43 | 1.2 |

As shown in Table 6, in Comparative Example 6-2 with the recesses at 1.5 mm second pitch distance with respect to the extending direction of first opening edges, the fastening force between the electric wire and the terminal connector was 43 N. On the other hand, in Examples 6-1 through 6-4 with the recesses at from 0.3 mm to 0.8 mm second pitch distance with respect to the extending direction of the core wire, the fastening force between the electric wire and the terminal connector was 62 N. Thus, the first pitch distance from 0.3 mm to 0.8 mm with respect to the extending direction of the core wire provided as great as 44 percent improvement in the fastening force between the electric wire and the terminal connector.

In Examples 6-1 through 6-4, the recesses are spaced at from 0.3 mm to 0.8 mm first pitch distance, i.e. at relatively small pitch distance, with respect to the extending direction of the electric wire. This increases the number, per unit area, of the recesses. This increases the area, per unit area, of the edges of the opening edges of the recesses. This increases the area, per unit area, in which the edges of the opening edges of the recesses bite into the core wire. As a result of this, the retention force of the wire barrel on the core wire is improved. This conceivably provided the improvement in the fastening force between the electric wire and the terminal connector.

Furthermore, in Comparative Example 6-2, the electrical resistance between the core wire and the terminal connector was 1.2 mΩ. On the other hand, in Examples 6-1 through 6-4, the electrical resistance between the core wire and the terminal connector was 0.7 mΩ. Thus, the second pitch distance from 0.3 mm to 0.8 mm provided as great as 42 percent reduction in the electrical resistance between the core wire and the terminal connector. Furthermore, because the electrical resistance between the core wire and the terminal connector in Examples 6-1 through 6-3 was 0.5 mΩ, the second pitch distance should be from 0.3 mm to 0.5 mm.

Second Embodiment

Figure 10:
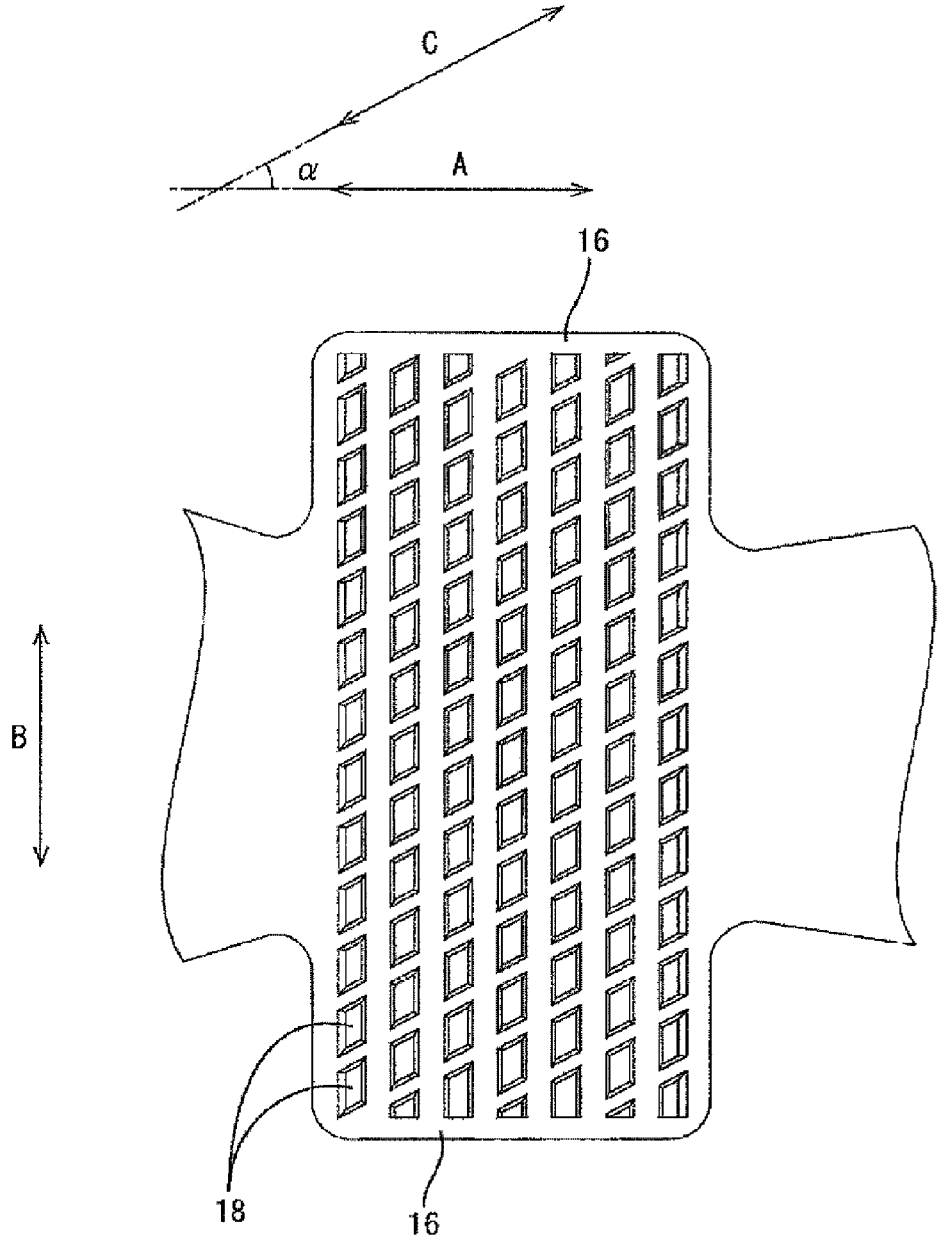
FIG. 10 is an enlarged plan view of a main part illustrating a developed state of a female terminal connector of a second embodiment.
Figure 11:
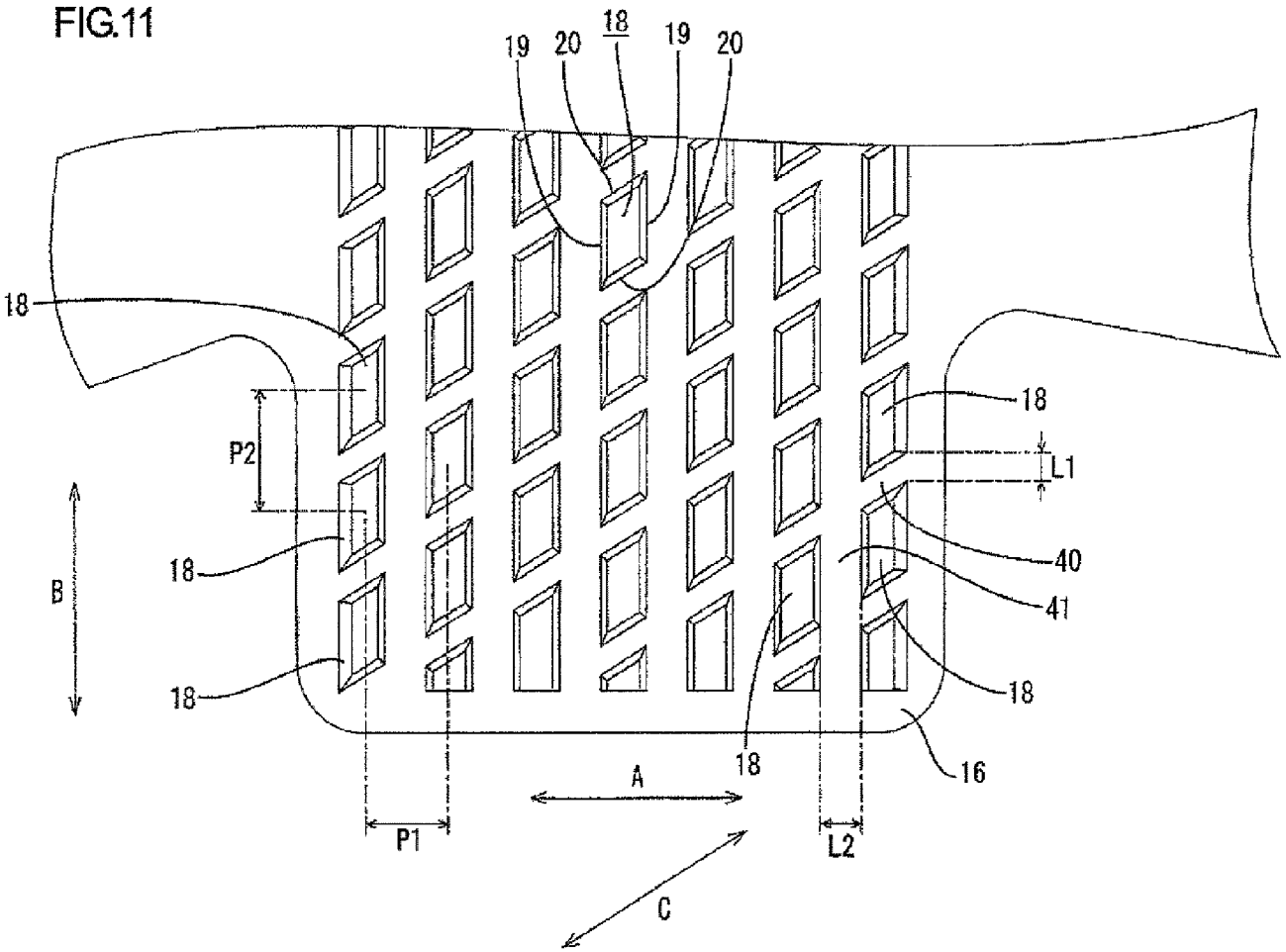
FIG. 11 is an enlarged plan view of a main part illustrating recesses formed in a wire barrel.

Next, a second embodiment will be described with reference to FIGS. 10 and 11. In this embodiment, the length of each first opening edge 19 is set at 0.38 mm. In addition, the space L1 between the recesses 18 adjacent to each other in the extending direction of the first opening edge 19 (in the direction illustrated by arrow B in FIG. 11) is set narrower than the space L2 between the recesses 18 adjacent to each other in the extending direction of the core wire 13 (in the direction illustrated by arrow A in FIG. 11). In this embodiment, the space L1 is set at 0.12 mm, while the space L2 is set at 0.19 mm.

Furthermore, a first area 40 is located between the recesses 18 adjacent to each other with respect to the extending direction of the first opening edges 19. The first area 40 extends in the extending direction of the second opening edges 20 (in the direction illustrated by arrow C in FIG. 11). As described above, the extending direction of the second opening edges 20 has an angle of 30 deg. to the extending direction of the core wire 13.

Furthermore, a second area 41 is located between the recesses 18 adjacent to each other in the extending direction of the core wire 13. The second area 41 extends in the extending direction of the first opening edges 19 (in the direction at right angles to the extending direction of the core wire 13).

The other configuration are substantially identical with the first embodiment. Therefore, the identical parts are designated by the same reference characters, while repetitive description will be omitted.

When the wire barrel 16 is crimped onto the core wire 13, the first area 40 and the second area 41, which are located between the respective adjacent recesses 18, of the wire barrel 16, are pressed onto the outer periphery of the core wire 13. Then, the oxide layer on the outer periphery of the core wire 13 is broken, so that the new surface of the core wire 13 is exposed. The new surface and the wire barrel 16 come into contact with each other so that the core wire 13 comes into electrical connection with the wire barrel 16.

In this embodiment, the space L1 between the recesses 18 adjacent to each other with respect to the extending direction of the first opening edges 19 is set narrower than the space L2 between the recesses 18 adjacent to each other with respect to the extending direction of the core wire 13. Accordingly, the first area 40 located between the recesses 18 adjacent to each other with respect to the extending direction of the first opening edges 19 is narrower in width than the second area 41 located between the recesses 18 adjacent to each other with respect to the extending direction of the core wire 13.

Because the first area 40 is relatively narrower in width as described above, the first area 40 is easy to bite into the core wire 13. As a result of this, the first area bites into the outer periphery of the core wire 13 so that the electrical resistance between the core wire 13 and the female terminal connector 12 can be reduced.

The first area 40 extends at the angle of 30 deg. to the extending direction of the core wire 13. Therefore, the first area 40 bites into the core wire 13 with being inclined with respect to the extending direction of the core wire 13. Therefore, rupture of the core wire 13 due to biting of the first area 40 into the core wire 13 is suppressed in comparison with the case where the first area 40 is at right angles to the extending direction of the core wire 13. This can suppress decrease in the retention force (in the fastening force) between the electric wire 11 and the female terminal connector 12.

Note that the second area 41 extending at right angles to the extending direction of the core wire 13 also bites into the outer periphery of the core wire 13 when the wire barrel 16 is crimped onto the core wire 13. However, because the second area is relatively wide in width, rupture of the core wire 13 is suppressed.

Other Embodiments

The present invention is not limited to the embodiments described above with reference to the drawings. For example, following embodiments are also included within the scope of the present invention.

(1) In the above embodiments, the recesses 18 of the wire barrel 16 have: the first pitch distance P1 of 0.4 mm with respect to the extending direction of the core wire 13; and the second pitch distance P2 of 0.5 mm with respect to the direction at right angles to the extending direction of the core wire 13. The pitch distances are not limited to this. The pitch distances may be set at any values upon as necessary. Furthermore, the pitch distances may have values either different from each other or same with each other.

(2) In the first embodiment, the length of each first opening edge 19 that configures the opening edge of the recess 18 is set at 0.25 mm. On the other hand, in the second embodiment, the length of each first opening edge 19 is set at 0.38 mm. The length of the first opening edge 19 is not limited to this. The length of the first opening edge 19 that configures the opening edge of the recess 18 may be set at any value upon as necessary.

(3) In the above embodiments, the aluminium electric wire is used. Even in a case where a copper electric wire is used, some effect, though not as great as the effects in the case of aluminium electric wire, is provided on the fastening force between the electric wire and the terminal connector due to adhesion etc., while causing no deficiencies due to the electrical resistance etc. between the core wire and the terminal connector in comparison with the conventional art. This makes it possible to apply the present invention also for use with the copper electric wire and also to a terminal connector applicable to both of the copper wire and the aluminium electric wire.

The invention claimed is:

1. A terminal connector including a crimping portion configured to be crimped onto a core wire exposed from an electric wire in a binding manner, the electric wire including the core wire including aluminium or aluminium alloy, the terminal connecter comprising:

in a state where the crimping portion is crimped onto the core wire, the crimping portion has a surface to be applied to the core wire, the surface having a plurality of recesses formed therein, each recess having an opening edge, the opening edge of the recess including a pair of first opening edges, the first opening edges being parallel to each other, the recesses being spaced in an extending direction of the first opening edges and being spaced in an extending direction of the electric wire;

each of the first opening edges has an angle from 85 deg. to 95 deg. to the extending direction of the electric wire; and wherein the space between the recesses adjacent to each other in the extending direction of the first opening edge is set narrower than the space between the recesses adjacent to each other in the extending direction of the electric wire.

2. The terminal connector according to claim 1, wherein the opening edge of the each recess is parallelogram-shaped, the opening edge of the recess includes a pair of second opening edges, the second opening edges are parallel to each other and differing from the first opening edges, the second opening edge has an angle from 25 deg. to 35 deg. to the extending direction of the electric wire.

3. The terminal connector according to claim 1, wherein the first opening edges are arranged to overlap with each other in the extending direction of the electric wire so that the first opening edges are present over the entire length of all over the plurality of the recesses on the crimping portion in the extending direction of the electric wire.

4. An electric wire with a terminal connector, the electric wire comprising:

an electric wire having a core wire including aluminium or aluminium alloy and wire insulation on the outer periphery of the core wire; and a terminal connector crimped onto the core wire exposed from the electric wire, the electric wire comprising:

the terminal connector includes a crimping portion to be crimped onto the core wire in a binding manner, in a state where the crimping portion is crimped onto the core wire, the crimping portion has a surface to be applied to the core wire, the surface having a plurality of recesses formed therein, each recess having an opening edge, the opening edge of the recess including a pair of first opening edges, the first opening edges being parallel to each other, the recesses being spaced in an extending direction of the first opening edges and being spaced in an extending direction of the electric wire;

the first opening edge has an angle from 85 deg. to 95 deg. to the extending direction of the electric wire; and wherein the space between the recesses adjacent to each other in the extending direction of the first opening edge is set narrower than the space between the recesses adjacent to each other in the extending direction of the electric wire.

5. The electric wire with a terminal connector according to claim 4, wherein the opening edge of the each recess is parallelogram-shaped, the opening edge of the recess includes a pair of second opening edges, the second opening edges are parallel to each other and differing from the first opening edges, the second opening edge has an angle from 25 deg. to 35 deg. to the extending direction of the electric wire.

6. The electric wire with a terminal connector according to claim 4, wherein the first opening edges are arranged to overlap with each other in the extending direction of the electric wire so that the first opening edges are present over the entire length of all over the plurality of the recesses on the crimping portion in the extending direction of the electric wire.

* * * * *

UNITED STATES PATENT AND TRADEMARK OFFICE

CERTIFICATE OF CORRECTION

PATENT NO. : 8,425,266 B2
APPLICATION NO. : 13/645369
DATED : April 23, 2013
INVENTOR(S) : Junichi Ono et al.

It is certified that error appears in the above-identified patent and that said Letters Patent is hereby corrected as shown below:

Title Page, delete the following item:

"(73) Assignee: Autonetworks Technologies, Ltd., Mie (JP); Sumitomo Wiring Systems I, Ltd., Mie (JP); Sumitomo Electric Industries, Ltd., Osaka (JP); Toyota Jidosha Kabushiki Kaisha, Toyota (JP)"

And Replace with:

(73) Assignee: Autonetworks Technologies, Ltd., Mie (JP); Sumitomo Wiring Systems, Ltd., Mie (JP); Sumitomo Electric Industries, Ltd., Osaka (JP); Toyota Jidosha Kabushiki Kaisha, Toyota (JP)

Signed and Sealed this
Second Day of July, 2013

Teresa Stanek Rea
*Acting Director of the United States Patent and Trademark Office*